US009261824B2

(12) United States Patent
Kikuchi

(10) Patent No.: US 9,261,824 B2
(45) Date of Patent: Feb. 16, 2016

(54) IMAGE FORMING APPARATUS ENSURING REDUCED INITIAL BLEEDING PHENOMENON

(71) Applicant: Kyocera Document Solutions Inc., Osaka (JP)

(72) Inventor: Einosuke Kikuchi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/499,177

(22) Filed: Sep. 27, 2014

(65) Prior Publication Data

US 2015/0093130 A1 Apr. 2, 2015

(30) Foreign Application Priority Data

Sep. 27, 2013 (JP) ..... 2013-200746

(51) Int. Cl.
*G03G 15/16* (2006.01)
*G03G 15/00* (2006.01)

(52) U.S. Cl.
CPC ..... *G03G 15/168* (2013.01); *G03G 15/80* (2013.01); *G03G 2215/0634* (2013.01); *G03G 2215/1614* (2013.01)

(58) Field of Classification Search
CPC ..... G03G 15/168; G03G 2215/16; G03G 2215/1614
See application file for complete search history.

(56) References Cited

U.S. PATENT DOCUMENTS

| | | | | |
|---|---|---|---|---|
| 7,398,043 | B2 * | 7/2008 | Ikeda et al. | 399/313 |
| 8,594,525 | B2 * | 11/2013 | Hirai et al. | 399/71 |
| 2006/0067729 | A1 * | 3/2006 | Ikeda et al. | 399/101 |
| 2009/0196665 | A1 * | 8/2009 | Tanaka et al. | 399/346 |
| 2012/0148286 | A1 * | 6/2012 | Hirai et al. | 399/71 |

FOREIGN PATENT DOCUMENTS

JP H05-027615 A 2/1993

* cited by examiner

*Primary Examiner* — David Gray
*Assistant Examiner* — Carla Therrien
(74) *Attorney, Agent, or Firm* — James W. Judge

(57) ABSTRACT

An image forming apparatus includes an apparatus main body, a power supply switch, a photoreceptor drum, a charging device, an exposure device, a developing device, a transfer roller, a cleaning device, and a toner-layer formation unit. The transfer roller contacts the circumferential surface of the photoreceptor drum at a downstream side with respect to the developing device in the rotation direction and is configured to transfer the toner image to a sheet. The cleaning device is cleaning device arranged opposed to the photoreceptor drum, downstream. The cleaning device is configured to clean the photoreceptor drum. The toner-layer formation unit is configured to form a toner layer on a surface of the transfer roller in an initial operation started after the apparatus main body is installed in a predetermined installation location and the power supply switch is switched on.

5 Claims, 8 Drawing Sheets

IMAGE FORMING APPARATUS ENSURING REDUCED INITIAL BLEEDING PHENOMENON

CROSS-REFERENCE TO RELATED APPLICATION

This application is based upon, and claims the benefit of priority from, corresponding Japanese Patent Application No. 2013-200746 filed in the Japan Patent Office on Sep. 27, 2013, the entire contents of which are incorporated herein by reference.

BACKGROUND

Unless otherwise indicated herein, the description in this section is not prior art to the claims in this application and is not admitted to be prior art by inclusion in this section.

A typical image forming apparatus, which forms images on sheets, includes a photoreceptor drum, developing device, and a transfer apparatus. After the developing device visualizes an electrostatic latent image formed on the circumferential surface of the photoreceptor drum as a toner image, the transfer apparatus transfers the toner image to a sheet. The transfer apparatus includes a transfer roller. The transfer roller is in abutting contact with the photoreceptor drum and rotatably driven. Applying a transfer bias to the transfer roller forms a transfer electric field in which toner moves from the photoreceptor drum to the transfer roller.

There is disclosed a certain technique that applies a cleaning bias to a transfer roller to remove toner attached to the transfer roller made of a rubber material. The technique stops applying the cleaning bias for a predetermined period after an image forming operation is terminated to solve a bleeding phenomenon, which is a phenomenon where remaining low molecular materials (impurities) on the transfer roller exude in the form of oil.

SUMMARY

An image forming apparatus according to the disclosure includes an apparatus main body, a power supply switch, a photoreceptor drum, a charging device, an exposure device, a developing device, a transfer roller, a cleaning device, and a toner-layer formation unit. The power supply switch is arranged on the apparatus main body. The photoreceptor drum is configured to be rotatably driven in a predetermined rotational direction, wherein an electrostatic latent image is formed on a circumferential surface of the photoreceptor drum. The photoreceptor drum being configured to carry a toner image. The charging device is configured to charge the circumferential surface of the photoreceptor drum. The exposure device is configured to irradiate the circumference surface of the photoreceptor drum with an exposure light so as to form the electrostatic latent image. The developing device is arranged opposed to the photoreceptor drum, the developing device housing toner charged to a predetermined polarity, and including a developing roller configured to supply the photoreceptor drum with the toner. The transfer roller is made of an elastic material, the transfer roller contacting the circumferential surface of the photoreceptor drum downstream, in the predetermined rotational direction, of the developing device, the transfer roller being configured to transfer the toner image to a sheet. The cleaning device is arranged opposed to the photoreceptor drum, downstream, in the predetermined rotational direction, of the transfer roller, the cleaning device being configured to clean the photoreceptor drum. The toner-layer formation unit is configured to form a toner layer on a surface of the transfer roller in an initial operation started after the apparatus main body is installed in a predetermined installation location and the power supply switch is switched on.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
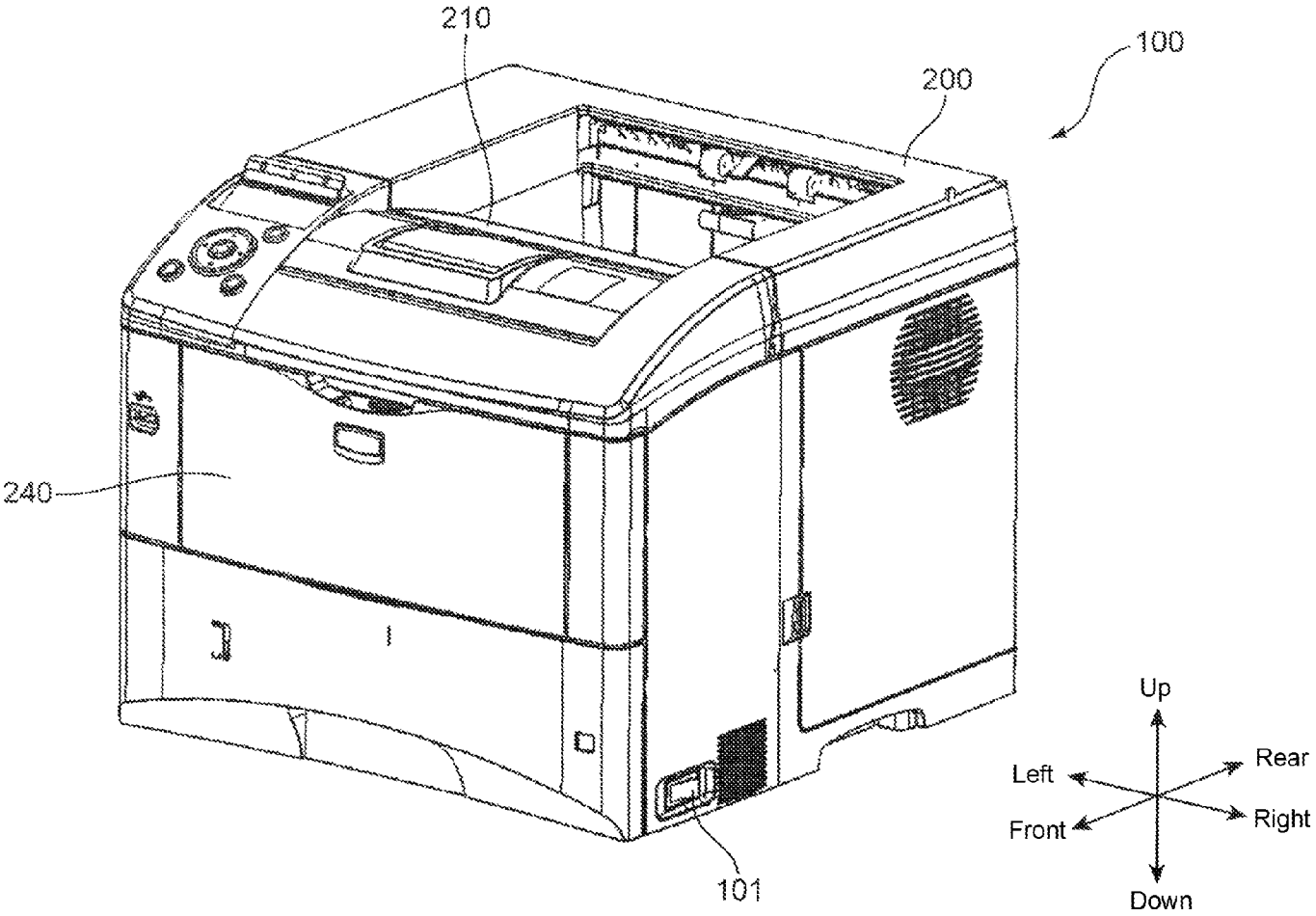
FIG. 1 perspectively illustrates an image forming apparatus according to an embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Figure 2:
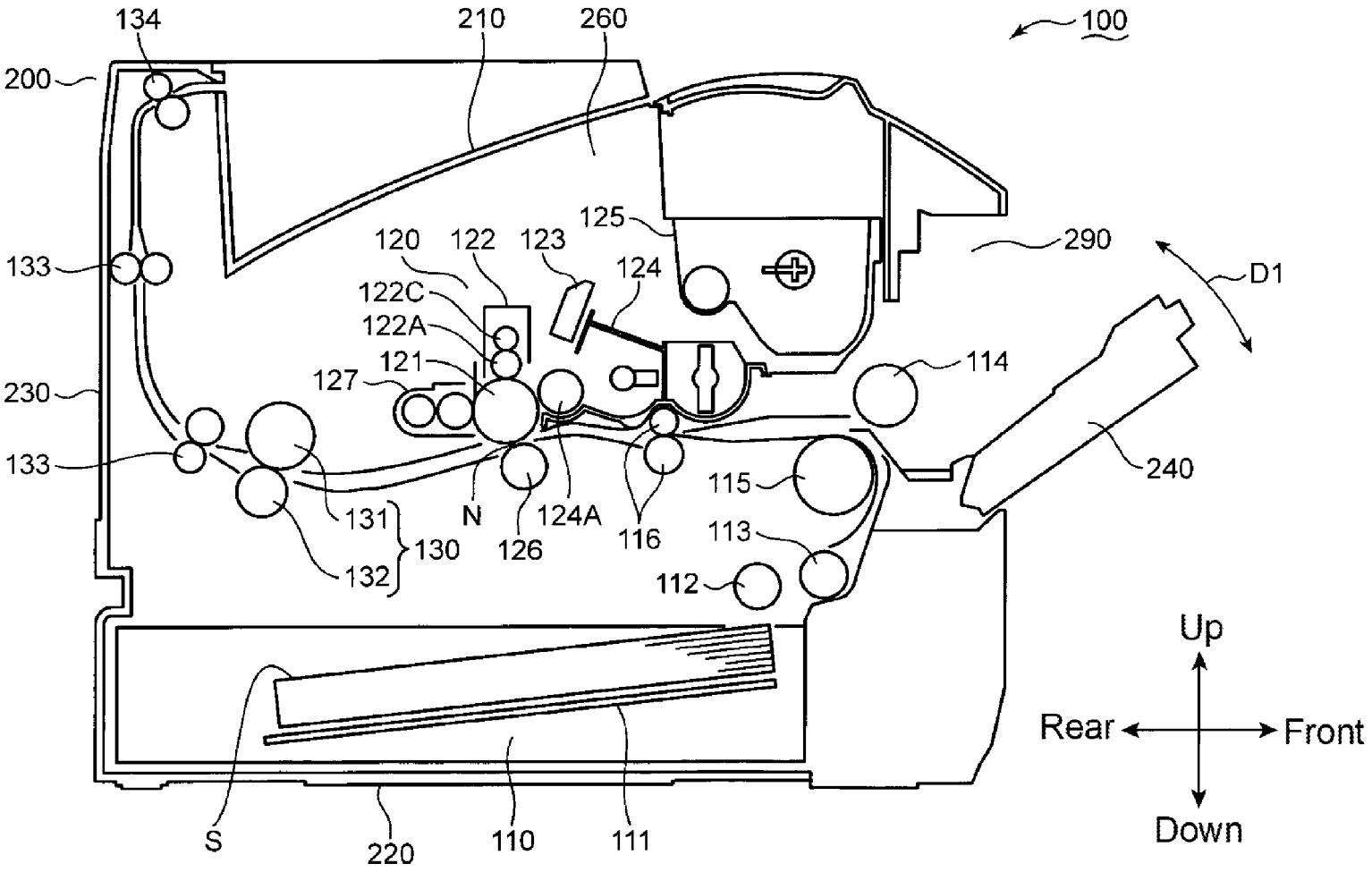
FIG. 2 illustrates an internal cross section of the image forming apparatus according to the one embodiment.

Hereafter, a description will be given of one embodiment of the disclosure with reference to the drawings. FIG. 1 perspectively illustrates a printer 100 (image forming apparatus) according to one embodiment of the disclosure. FIG. 2 illustrates an internal constitution of the printer 100 illustrated in FIG. 1. The printer 100 illustrated in FIG. 1 and FIG. 2 is a so-called black-and-white printer. However, in other embodiments, an image forming apparatus may be a color printer, a facsimile device, a multi-functional peripheral that includes these functions, or another apparatus for forming toner images on sheets. Directional terms such as "up," "down," "front," "rear," "left," and "right" are simply used for clarification of the following description without limiting principles of the image forming apparatus.

The printer 100 includes a housing 200 (apparatus main body) and a power supply switch 101. The housing 200 houses various devices for forming images on sheets S. The housing 200 includes an upper wall 210, a bottom wall 220, a back side wall 230, and a manual bypass tray 240. The upper wall 210 specifies a top surface of the housing 200. The bottom wall 220 specifies a bottom surface of the housing 200. The back side wall 230 is disposed upright between the upper wall 210 and the bottom wall 220. The manual bypass tray 240 is installed at the opposite side to the back side wall 230. The manual bypass tray 240 is vertically turnable having its lower end as a fulcrum (arrow D1 in FIG. 2). As illustrated in FIG. 2, downward turning of the manual bypass tray 240 opens an opening 290 formed at the housing 200. The opening 290 communicates with an inner space 260 of the housing 200. Accordingly, a user can access various devices housed in the inner space 260 of the housing 200 via the opening 290. Upward turning of the manual bypass tray 240 closes the opening 290. Consequently, unnecessary access to the inner space 260 by the user is prevented.

The power supply switch 101 (FIG. 1) is arranged on a lower end portion in a right-side surface of the housing 200. When a user or a maintenance worker of the printer 100 turns on the power supply switch 101, a predetermined voltage is applicable to the respective devices inside of the printer 100.

The printer 100 includes a cassette 110, a pickup roller 112, a first feed roller 113, a second feed roller 114, a conveyance roller 115, a registration roller pair 116, and an image forming unit 120.

The cassette 110 internally houses the sheets S. The cassette 110 includes a lift plate 111 that supports the sheets S. The lift plate 111 is inclined so as to push a leading edge of the sheets S up.

The pickup roller 112 is arranged above the leading edge of the sheets S pushed up by the lift plate 111. Rotation of the pickup roller 112 extracts the sheet S from the cassette 110.

The first feed roller 113 is installed at downstream of the pickup roller 112. The first feed roller 113 sends out the sheet S to further downstream. The second feed roller 114 is installed near the fulcrum of the manual bypass tray 240. The second feed roller 114 brings the sheet S on the manual bypass tray 240 into the housing 200. The user can selectively use the sheets S housed in the cassette 110 or the sheets S placed on the manual bypass tray 240.

The conveyance roller 115 is installed at downstream of the first feed roller 113 and the second feed roller 114. The conveyance roller 115 conveys the sheet S sent out by the first feed roller 113 and the second feed roller 114 to further downstream.

The registration roller pair 116 defines a position of the sheet S in a direction perpendicular to a conveyance direction. This adjusts a position of images formed on the sheets S. The registration roller pair 116 supplies the sheet S to the image forming unit 120 according to timing of image formation by the image forming unit 120.

The image forming unit 120 includes a photoreceptor drum 121, a charging apparatus 122, an exposure apparatus 123, developing device 124, a toner container 125, a transfer roller 126, a cleaning apparatus 127, and a static eliminator (not illustrated).

The photoreceptor drum 121 has an approximately cylindrical body shape. An electrostatic latent image is formed at a circumferential surface of the photoreceptor drum 121, and the photoreceptor drum 121 carries a toner image according to the electrostatic latent image. The photoreceptor drum 121 is rotatably driven in a predetermined rotation direction by a driving unit 303, which will be described later. In FIG. 2, the photoreceptor drum 121 rotates clockwise.

Application of a predetermined voltage causes the charging apparatus 122 to approximately evenly charge the circumferential surface of the photoreceptor drum 121. The charging apparatus 122 includes a charging roller 122A and a cleaning roller 122C. The charging roller 122A is rotatably driven while in contact with the circumferential surface of the photoreceptor drum 121. With this embodiment, the charging roller 122A is rotated driven by the photoreceptor drum 121 by a surface contact with the photoreceptor drum 121. A charging bias applying unit (not illustrated) applies a charging bias including a DC voltage of positive polarity to the charging roller 122A. Consequently, the circumferential surface of the photoreceptor drum 121 is charged at a predetermined surface potential VB (see FIGS. 7A to 7C). The cleaning roller 122C is rotatably driven by the charging roller 122A while in abutting contact with the surface of the charging roller 122A. The cleaning roller 122C cleans toner and foreign objects attached to the surface of the charging roller 122A.

The exposure apparatus 123 irradiates the circumferential surface of the photoreceptor drum 121 charged by the charging apparatus 122 with a laser beam (exposure light). The laser beam is directed according to image data output from an external device (not illustrated) such as a personal computer communicatively connected to the printer 100. Consequently, the electrostatic latent image corresponding to the image data is formed at the circumferential surface of the photoreceptor drum 121.

The developing device 124 internally houses toner. The developing device 124 includes a developing roller 124A. The developing roller 124A is arranged opposed to the photoreceptor drum 121. The developing roller 124A supplies the toner to the circumferential surface of the photoreceptor drum 121 on which the electrostatic latent image has been formed. The toner container 125 supplies the developing device 124 with the toner. When the developing device 124 supplies the toner to the photoreceptor drum 121, the electrostatic latent image formed on the circumferential surface of the photoreceptor drum 121 is developed (visualized). Consequently, a toner image is formed on the circumferential surface of the photoreceptor drum 121. With this embodiment, the toner features characteristics of charging to a positive polarity.

The transfer roller 126 is rotatably installed so as to contact the circumferential surface of the photoreceptor drum 121. Specifically, the transfer roller 126 contacts the circumferential surface of the photoreceptor drum 121 at a downstream side in the rotation direction of the photoreceptor drum 121 with respect to the developing device 124, so as to transfer the toner image on the photoreceptor drum 121 to the sheet S. The transfer roller 126 is made of an elastic material. In particular, in this embodiment, the transfer roller 126 is made of a foam rubber, more specifically, ethylene propylene rubber (EPDM). When the sheet S conveyed from the registration roller pair 116 passes through a transfer nip portion N (FIG. 2), which is located between the photoreceptor drum 121 and the transfer roller 126, the toner image formed on the circumferential surface of the photoreceptor drum 121 is transferred to the sheet S.

The cleaning apparatus 127 is arranged opposed to the photoreceptor drum 121 at the downstream side with respect to the transfer roller 126 in the rotation direction. After the transfer of the toner image to the sheet S, the cleaning apparatus 127 cleans toner remaining on the circumferential surface of the photoreceptor drum 121. The circumferential surface of the photoreceptor drum 121 cleaned by the cleaning apparatus 127 again passes through downward of the charging apparatus 122 to be evenly charged. Afterwards, the above-described formation of the toner image is newly performed.

The static eliminator is arranged between the cleaning apparatus 127 and the charging apparatus 122 in the rotation direction of the photoreceptor drum 121. The static eliminator irradiates the circumferential surface of the photoreceptor drum 121 with a charge removing light so as to diselectrify an electric charge remaining on the circumferential surface of the photoreceptor drum 121 after cleaning by the cleaning apparatus 127. Consequently, the charging apparatus 122 further uniformly charges the circumferential surface of the photoreceptor drum 121.

The printer 100 further includes a fixing unit 130 at a downstream side with respect to the image forming unit 120 in the conveyance direction. The fixing unit 130 fixes the toner image on the sheet S. The fixing unit 130 includes a heating roller 131 and a pressure roller 132. The heating roller 131 melts the toner on the sheet S. The pressure roller 132 causes the sheet S to bring into close contact with the heating roller 131. When the sheet S passes through between the heating roller 131 and the pressure roller 132, the toner image is fixed on the sheet S.

The printer 100 further includes a plurality of conveyance roller pairs 133 and a discharge roller pair 134. The conveyance roller pair 133 is installed at downstream of the fixing unit 130. The discharge roller pair 134 is installed at downstream of the conveyance roller pair 133. The conveyance roller pair 133 conveys the sheets S upward, and finally the discharge roller pair 134 discharges the sheets S from the housing 200. The sheets S discharged from the housing 200 are stacked on the upper wall 210.

Figure 3A:
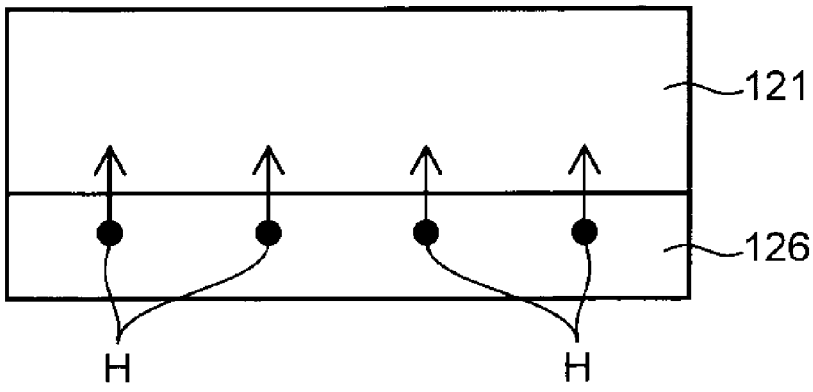
FIGS. 3A to 3C schematically illustrate a state where a photoreceptor drum is in contact with a transfer roller according to the one embodiment.
Figure 3B:
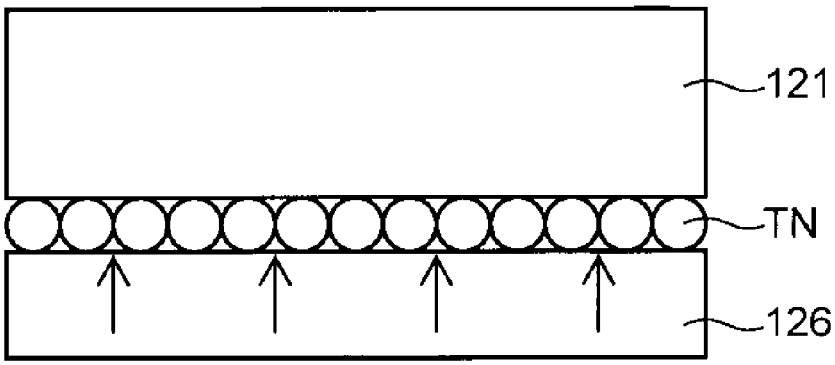
Figure 3C:
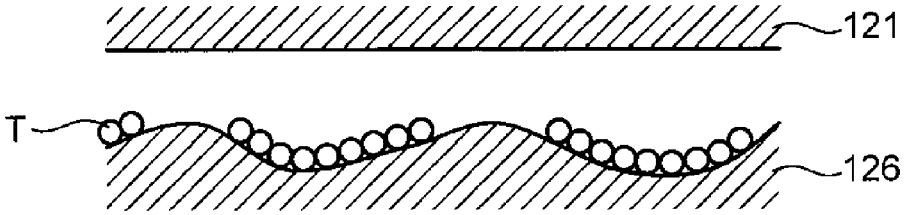
Figure 4:
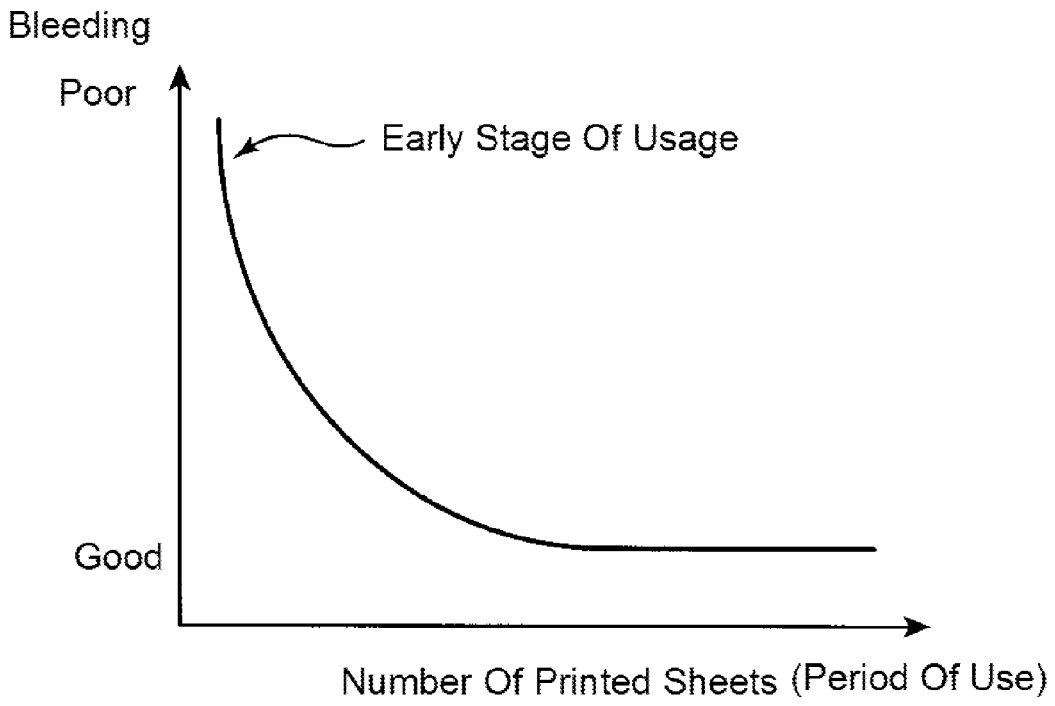
FIG. 4 schematically describes transition of a bleeding phenomenon.

FIGS. 3A to 3C schematically illustrate a state where the photoreceptor drum 121 is in contact with the transfer roller 126. FIG. 4 is a schematically describes transition of the bleeding phenomenon of the transfer roller 126. As described above, in this embodiment, the transfer roller 126 is made of the elastic material, more specifically, the foam rubber. In such a rubber material, the remaining low molecular material not chemically reacting during polymerization at production is partially immanent as impurities. The bleeding phenomenon where the impurities exude from the surface of the transfer roller 126 in the form of oil is likely to be a problem. With reference to FIG. 4, the bleeding phenomenon of the transfer roller 126, namely, exudation of the impurities decreases as the elapse of a period of use. In other words, the bleeding phenomenon is likely to be remarkable at an early stage of usage of the transfer roller 126.

When the printer 100 is started being used and the bleeding phenomenon occurs, as illustrated in FIG. 3A, impurities H exuded from the transfer roller 126 attach to the circumferential surface of the photoreceptor drum 121. Since charging characteristics of a part to which the impurities attach partially changes, an electric potential at the circumferential surface of the photoreceptor drum 121 is likely to be varied. Then, the electric potential variation brings image defects such as uneven print density and a fascia. Especially, in this embodiment, a contact electrification system where the charging apparatus 122 includes the charging roller 122A is employed. In view of this, the charge potential of the photoreceptor drum 121 by the charging roller 122A is susceptible to a surface condition of the photoreceptor drum 121. Accordingly, the bleeding phenomenon occurred at the early stage of usage of the printer 100 and the image defect caused by the bleeding phenomenon are problems.

Figure 5:
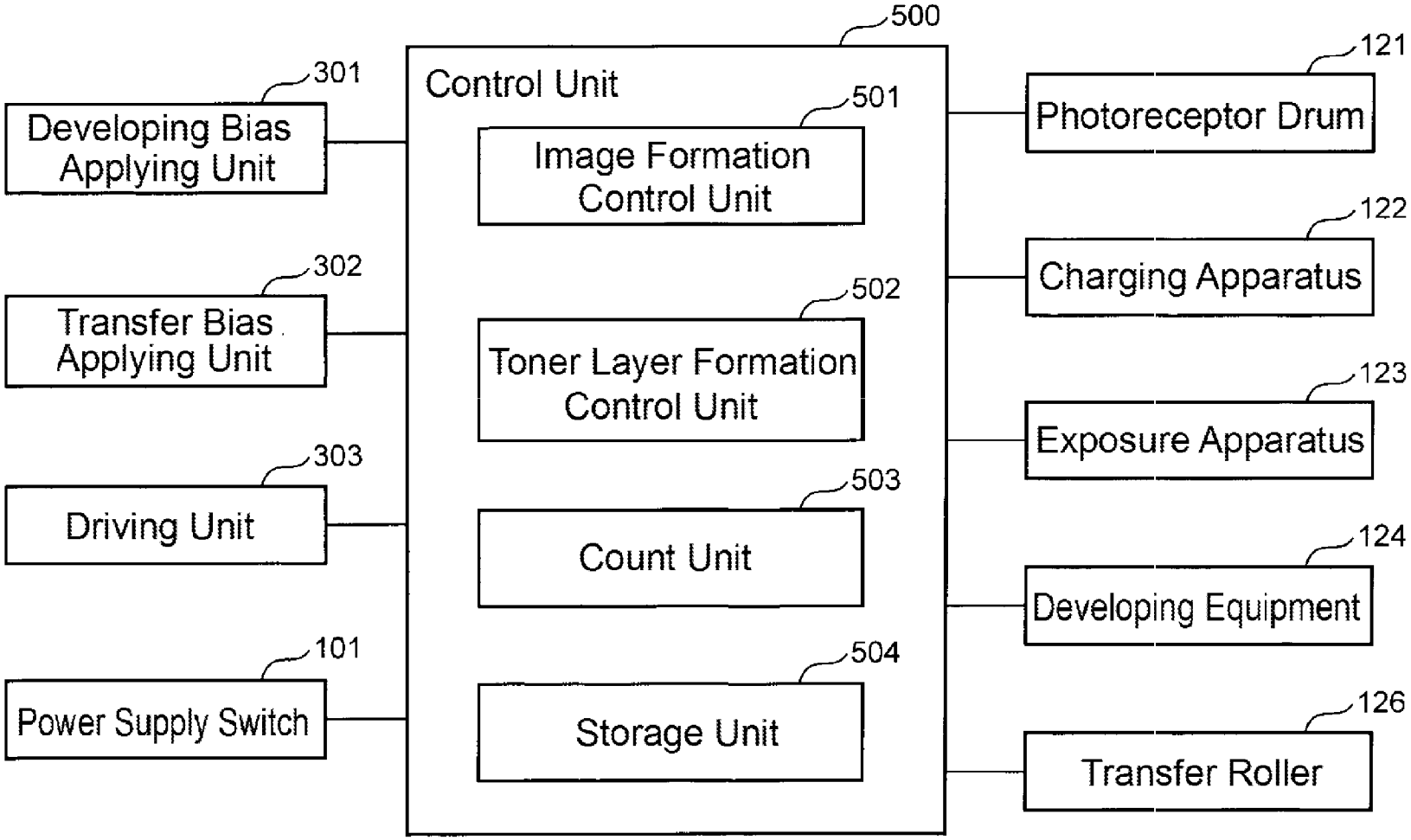
FIG. 5 illustrates an electrical configuration of the image forming apparatus according to the one embodiment.
Figure 6:
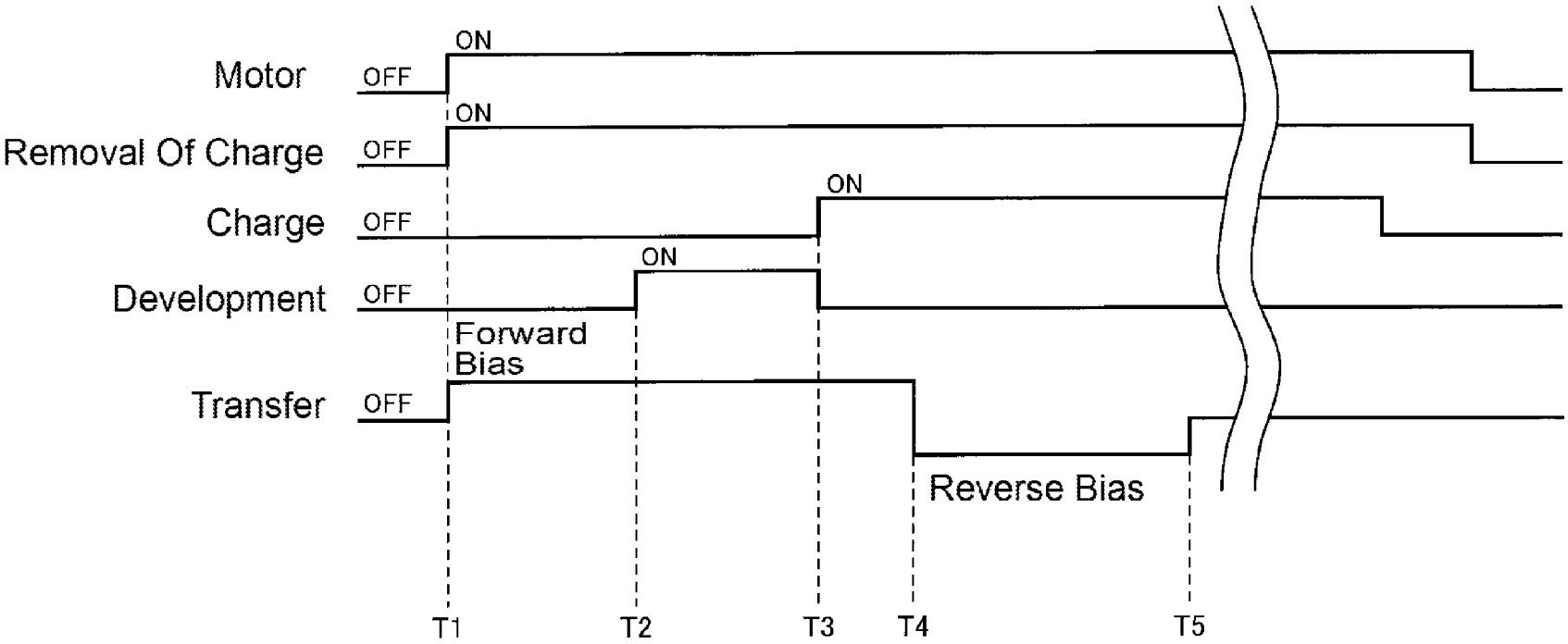
FIG. 6 illustrates a timing chart of a toner layer formation mode of the image forming apparatus according to the one embodiment.
Figure 7A:
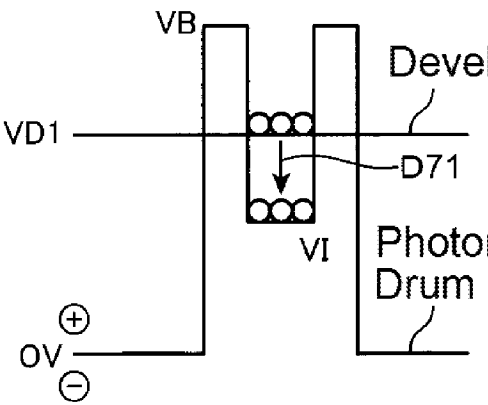
FIGS. 7A to 7C schematically describe an electric potential relationship among the photoreceptor drum, the developing device, and the transfer roller according to the one embodiment.
Figure 7B:
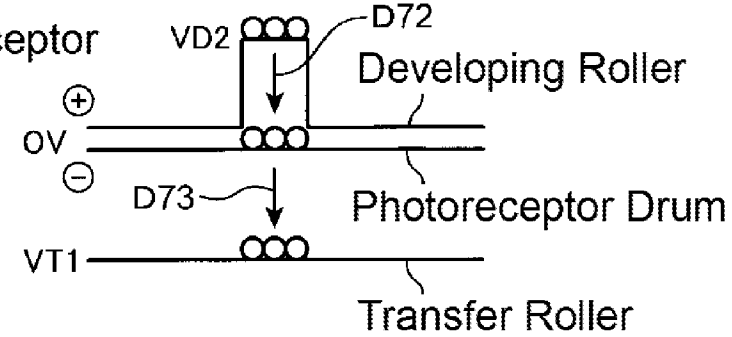
Figure 7C:
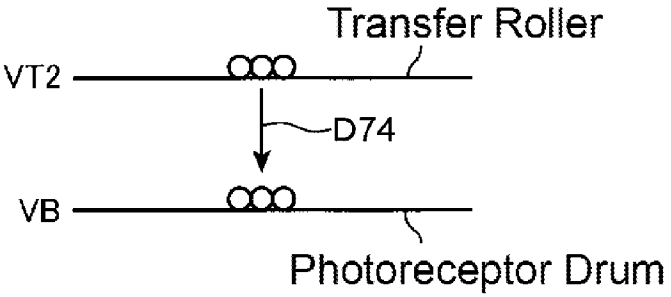

To solve these problems, with this embodiment, the printer 100 includes a toner layer formation control unit 502. Next, the following describes an electrical constitution of the printer 100 and the toner layer formation mode. FIG. 5 illustrates an electrical configuration of a control unit 500 to control an operation by the printer 100. FIG. 6 illustrates a timing chart of the toner layer formation mode of the printer 100 according to the embodiment. FIGS. 7A to 7C schematically describe an electric potential relationship among the photoreceptor drum 121, the developing roller 124A (the developing device 124), and the transfer roller 126.

The printer 100 includes the control unit 500, which controls operations of the respective units arranged inside of the housing 200. The control unit 500 includes a Central Processing Unit (CPU), a Read Only Memory (ROM) for storing a control program, a Random Access Memory (RAM) used as a work area for the CPU, or a similar unit. By running the control program stored in the ROM by the CPU, the control unit 500 functions as an image formation control unit 501, the toner layer formation control unit 502 (toner-layer formation unit), a count unit 503, and a storage unit 504. A developing bias applying unit 301, a transfer bias applying unit 302, and the driving unit 303 are electrically connected to the control unit 500, in addition to the above-described power supply switch 101, photoreceptor drum 121, charging apparatus 122, exposure apparatus 123, developing device 124, and transfer roller 126.

The developing bias applying unit 301 applies a developing bias VD (VD1, VD2) where an AC voltage is superimposed on the DC voltage to the developing roller 124A. The developing bias applying unit 301 is constituted of a high-voltage power supply to which a DC and an AC voltage are applicable. The developing bias applying unit 301 is controlled by the image formation control unit 501 and the toner layer formation control unit 502, which will be described later.

The transfer bias applying unit 302 applies a transfer bias VT (VT1, VT2), which is formed of a DC voltage, to the transfer roller 126. The transfer bias applying unit 302 is constituted of a high-voltage power supply that is able to apply a DC voltage. The transfer bias applying unit 302 is controlled by the image formation control unit 501 and the toner layer formation control unit 502, which will be described later.

The driving unit 303 is a motor to generate a driving power for driving the respective members inside of the printer 100. In particular, the driving unit 303 rotates the photoreceptor drum 121, the developing roller 124A of the developing device 124, and the transfer roller 126 at predetermined timings.

The image formation control unit 501 integrally controls the image forming operations by the printer 100. In the image forming operation, the image formation control unit 501 controls the charging bias applying unit (not illustrated) and applies the charging bias to the charging roller 122A. Consequently, the surface potential VB (FIG. 7A) of the photoreceptor drum 121 is set to 350 V. The image formation control unit 501 controls the developing bias applying unit 301 and applies a developing bias VD1 to the developing roller 124A. In this respect, this embodiment sets a DC component of the developing bias VD1 to +250 V as an example. Further, the image formation control unit 501 controls the exposure apparatus 123 to irradiate the photoreceptor drum 121 with an exposure light corresponding to the image data. In this respect, an image electric potential VI on the photoreceptor drum 121 corresponding to an image part (solid part) with the maximum density is set to 150 V. The 100 V-difference of electrical potential between the developing bias VD1 and the image electric potential VI on the photoreceptor drum 121 moves the toner from the developing roller 124A to the photoreceptor drum 121 as illustrated in the arrow D71 of FIG. 7A, thus forming the toner image.

In the image forming operation, the image formation control unit 501 controls the transfer bias applying unit 302 and applies a transfer bias VT to the transfer roller 126. In this respect, at a transfer timing at which the toner image is transferred from the circumferential surface of the photoreceptor drum 121 to the sheet S, a negative forward bias VT1, which has a reversed polarity of the polarity of the toner, is applied to the transfer roller 126. The image formation control unit 501 controls the forward bias VT1 by a constant current control such that −5 μA current flows through the transfer roller 126. The toner image is transferred from the circumferential surface of the photoreceptor drum 121 to which a positive electric potential has been set to the transfer roller 126 to which a negative electric potential has been set.

On the other hand, at an inter-sheet period corresponding to a period between the sheets S at which the plurality of sheets S pass through the transfer roller 126, a positive reverse bias VT2, which has the same polarity as the polarity of the toner, is applied to the transfer roller 126. The image formation control unit 501 controls the reverse bias VT2 to +500 V by the constant current control. Applying the reverse bias VT2 to the transfer roller 126 forms an electric field in which the toner moves from the transfer roller 126 to the photoreceptor drum 121. This prevents the surface of the transfer roller 126 from being stained with the toner at the inter-sheet period. Accordingly, this reduces a back surface of the sheet S passing through the transfer roller 126 subsequent to the inter-sheet period from being stained with the toner.

The toner layer formation control unit 502 forms a toner layer on the surface of the transfer roller 126 in the initial operation started after installing the printer 100 at a predetermined installation location and turning on the power supply switch 101. In particular, in this embodiment, the toner layer formation control unit 502 controls the developing bias applying unit 301 and provides the difference of electrical potential between the developing roller 124A and the photoreceptor drum 121 during the initial operation. This forms a toner band having a predetermined length in the rotation direction on the circumferential surface of the photoreceptor drum 121. Afterwards, the toner layer formation control unit 502 controls the transfer bias applying unit 302 to transfer the toner band to the surface of the transfer roller 126, thus forming the toner layer. Details of operations by the toner layer formation control unit 502 will further be described later.

The count unit 503 counts an accumulated period of use during which the printer 100 is used after installing the printer 100 at the predetermined installation location. The count unit 503 counts the accumulated rotation time of the photoreceptor drum 121 or the number of printed sheets of the printer 100 to count information on the accumulated period of use. The storage unit 504 stores the information on the period of use counted by the count unit 503 when necessary.

The following describes the toner layer formation mode executed by the toner layer formation control unit 502 with reference to FIG. 6 and FIGS. 7A to 7C. As described above, the toner layer formation control unit 502 forms the toner layer on the surface of the transfer roller 126 in the initial operation started after installing the printer 100 at a predetermined installation location and turning on the power supply switch 101. In this embodiment, the installation location means a usage installation location at which the printer 100 is used after the printer 100 is shipped from a plant. In other words, the installation location corresponds to a usage environment of the printer 100 by a customer. The initial operation includes adjustment of the respective members of the printer 100 and a setup operation for an image quality of printed images.

After installing the printer 100 at the installation location and turning on the power supply switch 101, the toner layer formation control unit 502 executes the toner layer formation mode (see time T1 in FIG. 6). In this respect, the toner layer formation control unit 502 controls the driving unit 303 (which corresponds to the motor in FIG. 6) to rotatably drive the photoreceptor drum 121, the developing roller 124A of the developing device 124, and the transfer roller 126. The toner layer formation control unit 502 controls the static eliminator to irradiate the photoreceptor drum 121 with a charge removing light. Further, the toner layer formation control unit 502 controls the transfer bias applying unit 302 to apply the forward bias VT1 to the transfer roller 126 as the transfer bias VT. As illustrated in FIG. 6, from the time T1 to time T2, the charging bias is not applied to the charging apparatus 122. Accordingly, the surface potential of the photoreceptor drum 121 is set to 0 V.

Further, the toner layer formation control unit 502 applies the developing bias VD to the developing roller 124A at the time T2. In this respect, the toner layer formation control unit 502 controls the developing bias applying unit 301 to apply a developing bias VD2 to the developing roller 124A as the developing bias VD. The developing bias VD2 is set to +100 V. The 100 V-difference of electrical potential between the developing bias VD2 and the surface potential (0 V) on the photoreceptor drum 121 moves the toner from the developing roller 124A to the photoreceptor drum 121 as illustrated in an arrow D72 of FIG. 7B, thus forming the toner image.

An AC bias may be further applied to the developing roller 124A. Thus, in the toner layer formation mode, the circumferential surface of the photoreceptor drum 121 is not charged, and moreover, the circumferential surface of the photoreceptor drum 121 is not exposed by the exposure apparatus 123. Thus, the developing bias VD (VD2) applied to the developing roller 124A forms the toner image on the circumferential surface of the photoreceptor drum 121.

The toner image has a predetermined width corresponding to a region that the developing roller 124A can carry the toner in the axial direction of the photoreceptor drum 121. The toner image has a predetermined length in the rotation direction of the photoreceptor drum 121. Accordingly, the toner image is formed into a band shape (toner band) on the circumferential surface of the photoreceptor drum 121.

A length LB in the rotation direction of the toner band is adjusted by a time period (from the time T1 to the time T2) at which the developing bias VD2 is applied to the developing roller 124A. That is, assume that a peripheral velocity of the photoreceptor drum 121 is VR (mm/sec) and $\Delta T = T2 - T1$ (sec), the length $LB = VR \times \Delta T$. In this embodiment, assume that a perimetric length of the transfer roller 126 is LT (mm), T1 and T2 are preliminary set so as to meet $LB > LT$. In other words, the length LB of the toner band in the rotation direction on the photoreceptor drum 121 is set longer than the perimetric length LT of the transfer roller 126.

With reference to FIG. 6, simultaneously with ending formation of the toner band on the photoreceptor drum 121, the toner layer formation control unit 502 controls the charging bias control unit (not illustrated) to apply the charging bias to the charging apparatus 122 (see the time T3). Consequently, the surface potential VB of the photoreceptor drum 121 is set to 350 V. On the other hand, the surface potential of the region, which is at the circumferential surface of the photoreceptor drum 121, at which the toner band is formed, is 0 V as described above. In view of this, up to time T4, the toner band is transferred from the photoreceptor drum 121 to the transfer roller 126 to which the forward bias VT1 has been applied (see the arrow D73 in FIG. 7B). In this respect, as described above, since the length LB of the toner band is set longer than the perimetric length LT of the transfer roller 126, a toner layer TN is stably formed across the entire transfer roller 126 in the circumferential direction (FIG. 3B). The toner layer TN adsorbs a part of impurities exuded from the surface of the transfer roller 126.

Further, from the time T4 to time T5 in FIG. 6, the toner layer formation control unit 502 applies the reverse bias VT2 (+500 V) to the transfer roller 126 as the transfer bias while rotating the transfer roller 126 by equal to or more than one round. Consequently, as indicated by the arrow D74 in FIG. 7C, the toner layer TN formed at the surface of the transfer roller 126 is reversely transferred to the photoreceptor drum 121 side. In this respect, after most toner adsorbing a part of the impurities is removed from the surface of the transfer roller 126 to the photoreceptor drum 121 side, the cleaning apparatus 127 removes the toner. Accordingly, the surface of the transfer roller 126 at which the toner layer TN is formed is cleaned. This prevents the back surface of the sheet S from being stained with the toner in subsequent image forming operations. Note that a slight amount of toner remains on the surface of the transfer roller 126 to which the reverse bias VT2 is applied due to a mechanical (superficial) adhesive force. In view of this, a protective film formed of a thin toner layer is formed on the surface of the transfer roller 126. Consequently, the toner layer blocks the impurities, which is likely to exude at the beginning. This prevents the impurities from attaching from the transfer roller 126 to the photoreceptor drum 121 in use after the initial operation. This ensures providing the printer 100 that stably reduces the bleeding phenomenon where the impurities attach from the transfer roller 126 to the photoreceptor drum 121. In particular, to reduce the cost of the printer 100, even if a mechanism for evacuating the transfer roller 126 from the photoreceptor drum 121 is not provided, an image defect based on the bleeding phenomenon can be prevented.

In this embodiment, when the toner layer is formed at the transfer roller 126, the toner band formed on the photoreceptor drum 121 is used. In view of this, using the toner housed in the developing device 124, the toner layer can be formed on the surface of the transfer roller 126.

In this embodiment, even if the transfer roller 126 is constituted of a foam rubber from which the impurities are likely to exude at the beginning, the toner layer blocks the impurities. As illustrated in FIG. 3C, toner T is slightly accumulated in a concavo-convex shape at the surface of the transfer roller 126 made of the foam rubber. In view of this, shielding effect against the impurities can be continuously maintained. This prevents the impurities from attaching to the photoreceptor drum 121.

To make additional remarks on the function of the toner layer formation control unit 502, the toner layer formation control unit 502 has a function of forcible aging of the surface of the transfer roller 126. That is, by attaching the toner on the surface of the transfer roller 126 where the bleeding phenomenon is initially remarkable, an extremely thin toner layer covers the surface of the transfer roller 126. As described above, even if the toner is removed by the reverse bias after attaching the toner formed of the toner band to the surface of the transfer roller 126, toner slightly buried on the surface of the transfer roller 126 or toner attached by mechanical adhesive force is not detached. The toner forcibly ages the transfer roller 126, thus reducing the initial bleeding phenomenon.

The printer 100 (image forming apparatus) according to the embodiment of the disclosure is described above. However, this should not be construed in a limiting sense. For example, the disclosure can employ the following modifications.

(1) In the embodiment, an aspect where the toner layer formation control unit 502 forms the toner layer on the surface of the transfer roller 126 in the initial operation after installing the printer 100 at the predetermined installation location and turning on the power supply switch 101 is described. However, the disclosure is not limited to this. The toner layer formation control unit 502 may be an aspect that forms the toner layer on the surface of the transfer roller 126 every time the power supply switch 101 is turned on during a predetermined period after the initial operation is terminated. In this case, the count unit 503 counts, and an execution period of the toner layer formation mode is controlled based on information on the period of use stored in the storage unit 504. As one example, until the printer 100 cumulatively prints 100 sheets, the toner layer formation mode is executed every time the power supply switch 101 is turned on. Accordingly, in the early stage of usage at which the bleeding phenomenon is likely to occur in the transfer roller 126, the toner layers can be continuously formed at the transfer roller 126. Accordingly, the image defect caused by the bleeding phenomenon can further be stably reduced.

(2) In the embodiment, an aspect where the toner band is formed on the photoreceptor drum 121 by the developing bias VD2 applied to the developing roller 124A while stopping the charging operation by the charging apparatus 122 is described. However, the disclosure is not limited to this. That is, the following aspect may be employed. Similarly to an usual image forming operation, after the charging apparatus 122 charges the photoreceptor drum 121, the exposure apparatus 123 forms an electrostatic latent image and the developing device 124 develops the electrostatic latent image. Thus, the toner band is formed.

Figure 8B:
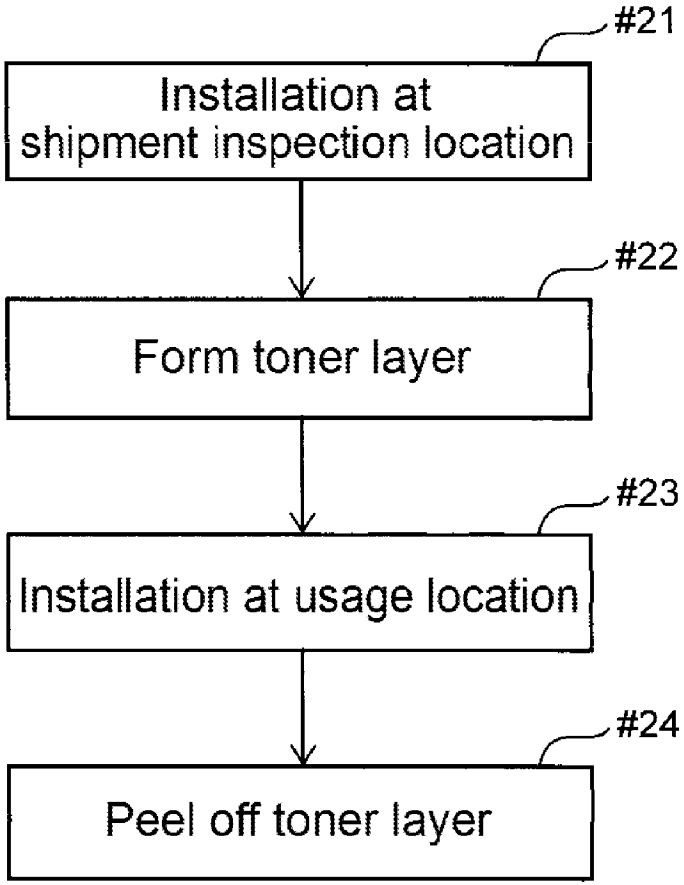
FIGS. 8A and 8B illustrate flowcharts for describing an execution timing of the toner layer formation mode according to the one embodiment.
Figure 8A:
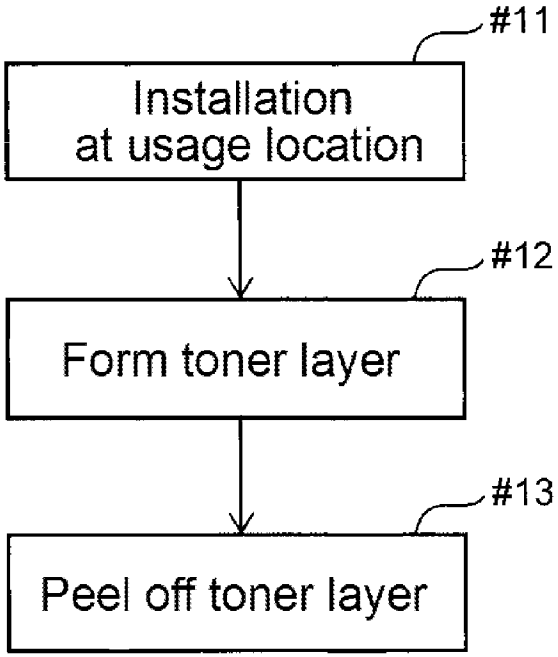

(3) In the embodiment, an aspect where the timing of the initial operation at which the toner layer is formed at the surface of the transfer roller 126 is the timing when installing the printer 100 at the usage installation location is described. However, the disclosure is not limited to this. The installation location may be an inspection location at which a shipment inspection is conducted after producing the printer 100. FIGS. 8A and 8B describe an execution timing of the toner layer formation mode.

In the previous embodiment, as illustrated in FIG. 8A, after installing the printer 100 at the usage installation location (#11 in FIG. 8A), the toner layer is formed at the transfer roller 126 (#12 in FIG. 8A). Further, applying the reverse bias VT2 to the transfer roller 126 peels off the toner layer from the transfer roller 126 (#13 in FIG. 8A).

On the other hand, in this modification, as illustrated in FIG. 8B, when the printer 100 is installed at the inspection location (#21 in FIG. 8B), after turning on the power supply switch 101, the toner layer is formed on the transfer roller 126 (#22 in FIG. 8B). Then, after performing a predetermined packing, the printer 100 is installed at the previous usage installation location (#23 in FIG. 8B). Then, at the usage installation location, the toner layer formation control unit 502 applies the reverse bias VT2 to the transfer roller 126, thus peeling off the toner layer from the transfer roller 126 (#24 in FIG. 8B). That is, the toner layer formation control unit 502 applies the transfer bias (the reverse bias VT2), which has the reversed polarity of the polarity during the transfer to the transfer roller 126, while rotating the transfer roller 126 by equal to or more than one round at the usage installation location, thus reversely transferring the toner layer to the photoreceptor drum 121.

With this constitution, before the user starts using the printer 100, the bleeding phenomenon can be preliminary reduced in a shipment inspection phase. After the shipment inspection and until the printer 100 is installed at the usage installation location, even if the printer 100 is transported with the transfer roller 126 in abutting contact with the photoreceptor drum 121, attachment of impurities from the transfer roller 126 to the photoreceptor drum 121 during the transportation is prevented. The toner layer can be peeled off from the transfer roller 126 before the user starts using the image forming apparatus. This prevents a stain at the back surface of the sheet S. As another modification, both of the formation and peeling of the toner layer of the transfer roller 126 may be performed at the inspection location.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus, comprising:

an apparatus main body;

a power supply switch arranged on the apparatus main body;

a photoreceptor drum configured to be rotatably driven in a predetermined rotational direction, wherein an electrostatic latent image is formed on a circumferential surface of the photoreceptor drum;

a charging device including a charging roller circumferentially in contact with the photoreceptor drum;

a charging bias applying unit configured to apply to the charging roller a charging bias including a positive DC voltage;

an exposure device configured to irradiate the circumferential surface of the photoreceptor drum with an exposure light so as to form the electrostatic latent image;

a developing device arranged opposed to the photoreceptor drum, the developing device housing toner charged to a predetermined polarity, and including a developing roller;

a developing bias applying unit configured to apply a predetermined developing bias to the developing roller such as to develop the electrostatic latent image on the photoreceptor drum into a toner image;

a transfer roller made of an elastic material, the transfer roller contacting the circumferential surface of the photoreceptor drum downstream, in the predetermined rotational direction, of the developing device;

a transfer bias applying unit configured to apply to the transfer roller a predetermined toner-image transfer bias of reverse polarity to the polarity of the toner so as to transfer the toner image to a sheet;

a cleaning device arranged opposed to the photoreceptor drum, downstream, in the predetermined rotational direction, of the transfer roller, the cleaning device being configured to clean the photoreceptor drum; and a control unit, the control unit including a toner-layer formation unit, and configured to, in starting operation begun by a predetermined post-setup instance of the power supply switch being switched on, control the charging bias applying unit not to apply the charging bias to the charging roller, such that the surface potential of the photoreceptor drum will be 0 V, and at the same time control the toner-layer formation unit to control the developing bias applying unit to provide a difference of electrical potential between the developing roller and the photoreceptor drum so as to form a toner band of predetermined length in the predetermined rotational direction on the circumferential surface of the photoreceptor drum, and control the transfer bias applying unit to apply the predetermined toner-image transfer bias to the transfer roller so as to transfer the toner band superficially onto the transfer roller, thereby forming a toner layer on the transfer roller.

2. The image forming apparatus according to claim 1, wherein:

a length of the toner band in the predetermined rotational direction is longer than the perimetric length of the transfer roller.

3. The image forming apparatus according to claim 1, wherein:

the toner-layer formation unit is configured to apply to the transfer roller a transfer bias of polarity reverse to that during the transfer while rotating the transfer roller by equal to or more than one turn, so as to reversely transfer the toner layer to the photoreceptor drum after the toner layer is formed on the surface of the transfer roller.

4. The image forming apparatus according to claim 1, wherein the transfer roller is made of foam rubber.

5. The image forming apparatus according to claim 1, wherein:

the predetermined post-setup instance is one of every time the power supply switch is switched on during a predetermined period beginning with an initial operation of the image forming apparatus.

* * * * *